US008807043B2

(12) United States Patent
Gustafsson

(10) Patent No.: US 8,807,043 B2
(45) Date of Patent: Aug. 19, 2014

(54) TRACK AND BOGIE FOR SUSPENDED VEHICLES

(75) Inventor: Bengt Gustafsson, Linköping (SE)

(73) Assignee: Beamways AB (SE)

( * ) Notice: Subject to any disclaimer, the term of this patent is extended or adjusted under 35 U.S.C. 154(b) by 200 days.

(21) Appl. No.: 13/375,522

(22) PCT Filed: Jun. 2, 2009

(86) PCT No.: PCT/SE2009/050647

§ 371 (c)(1),
(2), (4) Date: Jan. 19, 2012

(87) PCT Pub. No.: WO2010/140934

PCT Pub. Date: Dec. 9, 2010

(65) Prior Publication Data

US 2012/0125221 A1 May 24, 2012

(51) Int. Cl.
*B61B 3/00* (2006.01)
*E01B 25/22* (2006.01)
*B61B 13/04* (2006.01)

(52) U.S. Cl.
CPC ..... *B61B 13/04* (2013.01); *E01B 25/22* (2013.01)
USPC ..... 104/91; 105/148

(58) Field of Classification Search
CPC ..... B61B 3/00; B61B 3/02; B61B 13/04; E01B 25/08; E01B 25/10; E01B 25/12
USPC ..... 104/89, 91, 93–95, 118, 119; 105/141, 105/144–148, 154, 155
See application file for complete search history.

(56) References Cited

U.S. PATENT DOCUMENTS

| | | | | |
|---|---|---|---|---|
| 3,830,163 | A * | 8/1974 | Wright et al. | 104/105 |
| 3,855,941 | A | 12/1974 | Fromme et al. | |
| 4,000,700 | A | 1/1977 | Hannover et al. | |
| 4,702,173 | A | 10/1987 | Perrott | |
| 4,841,871 | A | 6/1989 | Leibowitz | |
| 5,005,488 | A | 4/1991 | Lainio | |
| 2007/0000405 | A1 | 1/2007 | Nakao | |

* cited by examiner

*Primary Examiner* — R. J. McCarry, Jr.
(74) *Attorney, Agent, or Firm* — Roger D. Emerson; Emerson Thomson Bennett, LLC

(57) ABSTRACT

The present invention includes a track (1, 101) of a track system with straight, transition, curved, and switch track sections. The invention further comprises bogies (40) for vehicle cabins suspended under the track. Track sections of the track have an upper rail (1) and one or two lower rails (101, 201). Further, a bogie (40) has fore and aft sets of upper guide and switch wheels (151, 251, 154, 254), and one set of lower guide and switch wheels (152, 153, 252, 253, 156, 157, 256, 257). The bogies (40) also have one left and/or one right load bearing wheel (150, 250) and one drive wheel facing upwards and engaging a downwards directed drive wheel running surface (15) of the upper rail. Each set of lower guide wheels consist of left and right wheel pairs (152, 153, 252, 253) so that transition sections can be passed without moving any parts of the bogie (40). Switch wheels (154, 254, 156, 157, 256, 257) are separated from guide wheels so that they can be positioned according to the preferred direction of travel well before reaching a switch.

18 Claims, 7 Drawing Sheets

TRACK AND BOGIE FOR SUSPENDED VEHICLES

FIELD OF THE INVENTION

The present invention relates to a track and bogie for wheel based suspended vehicles. Vehicles provided with at least two of said bogies form together with said track a transportation system. In particular the invention is useful for public transportation often denoted as PRT (personal rapid transit).

BACKGROUND OF THE INVENTION

The problems with transporting the large and increasing number of people living in cities are well known. Public transportation with large vehicles in the form of metro, trolley and buses all have the problem with people having to wait for vehicles to arrive and then stop at all stations during the trips. Cars offer the flexibility of a personal trip but have problems with pollution, accidents, congestion and land use. A transit system which offers the flexibility of the car without its drawbacks is widely known as PRT.

Many PRT systems have been described and patented. These systems can be characterized as having rotating motors driving on wheels or linear motors. The wheel traction based systems have problems with loss of traction in some weather conditions while the linear electric motor systems have an economic and efficiency problem, as linear electric motors are in general more expensive and less efficient than rotating electric motors. For large vehicle systems like trains the uncertain traction can be compensated with long headways, i.e. inter-vehicle times. This is not possible for a system with small vehicles as the reduced track capacity would make the system economically infeasible.

Vehicles of PRT systems can further be characterized as either supported on the track or suspended under the track. One main advantage with a suspended system is to avoid accumulation of snow, water or debris on the running surfaces of the track. A suspended system can achieve this by having only one track opening, facing downwards, greatly reducing the risk of foreign particles entering the track.

Many previous PRT systems have been designed with cabins suspended under the track. One main problem with this type of configuration is that the running surfaces on each side of the track opening must be kept at a constant lateral distance. This is structurally complicated as the track usually has a rather high U-shape internally to allow vehicles to pass. This problem is compounded by the fact that a vehicle is subjected to lateral forces acting on the cabin. These lateral forces translate to torsional moments which tend to pry the track open, i.e. to increase the width of the track opening. To avoid this the track must be made stiff, which increases its weight, cross-section size and cost.

To implement a PRT system a possibility to individually switch each vehicle to a selected track at switch points is required. Many systems having an on board switch mechanism have been designed and patented. Such designs have the advantage of allowing switching without moving parts in the track. A problem with this type of switch mechanism, particularly for a suspended vehicle configuration, is to maintain the possibility to transfer above mentioned torsional moments from the vehicle cabin to the track at all times when negotiating switches.

U.S. Pat. No. 3,830,163 describes a PRT system. A vehicle of said prior art PRT system does not have separate guide and switch wheels, which means that switching movement must be performed when the guide/switch wheels are under pressure from torsional moments, causing wear of wheels and tracks, noise and excessive energy use. In addition the system has drive wheels bearing down on an upwards facing surface of the track, an arrangement which does not provide a safe traction as stated above. Furthermore the switch mechanism of said disclosure has a downwards facing central rail which prevents the use of upwards facing drive wheels.

SUMMARY OF THE INVENTION

The present invention includes a transportation system track with straight, transition, curved, and switch sections. The invention further comprises bogies for vehicle cabins suspended under said track. Track sections of the track have an upper rail referred to as first track member and one or two lower rails referred to as second track members. Straight and curved track sections have one lower rail on the left or right side, as made appropriate by the side preferred for placing cantilevered posts upholding the track. Transition sections have two lower rails, left and right, and are used between two straight or curved track sections having opposite side lower rails. Switches have two lower rails on the common route and one each on the two alternate routes of the switch. Furthermore, in switch sections, these lower rails are special in that while maintaining engagement with respective load bearing wheels of a bogie guided by said track they no longer engage the lower guide wheels of the bogie. This arrangement allows the bogie to select a left or a right alternate route out of the switch by positioning switch wheels of the bogie appropriately, as will be described below.

Bogies of a preferred configuration have two sets of upper guide and switch wheels, and one set of lower guide and switch wheels. They also have one left and one right load bearing wheel and one drive wheel facing upwards, engaging a downwards facing running surface of the first track member. Each set of lower guide wheels consist of left and right wheel pairs so that transition sections can be passed without moving any parts of the bogie. Switch wheels are separate from guide wheels so that they can be positioned according to the preferred direction of travel well before reaching a switch.

According to one aspect of the invention a track with the characteristics of the enclosed claim 1 is presented.

According to a further aspect of the invention a suspended bogie with the characteristics of the enclosed independent claim 8 is presented.

According to a further aspect of the invention a transportation system comprising said track, said suspended bogie and a vehicle is presented as claim 18.

Further aspects and embodiments of the invention are presented in the dependent claims.

The present invention preferably uses rotating electric motors and ensures the most reliable friction possible by locating the running surface receiving the drive wheel facing downwards inside a mostly enclosed first track member provided with a downward facing opening. The contact force of a drive wheel of a bogie when engaging the drive wheel running surface can be adjusted using a servo mechanism. The contact force is adjusted to accommodate different drive/brake force requirements and coefficients of friction, thus preventing any significant slippage of the drive wheels while minimizing the rolling resistance in each drive wheel.

A vehicle being guided along the track of the track system comprises a cabin suspended from two or more of the bogies described herein, said bogies arranged in line, one after the other, wherein the two or more bogies of a vehicle are coupled to each other.

Advantages accomplished by means of the invention are:

- a minimization of the drawback with respect to possible loss of friction when using a rotating electric motor so that short inter-vehicle headways can be achieved with maintained system safety in all weather conditions.
- a minimization of energy loss due to rolling resistance.
- a reduction of the risk of accumulation of snow, water or debris inside the track.
- elimination of the above mentioned adverse effects of torsional moments, whereby a reduction of track weight, cross-section size and cost compared to other systems is achieved.
- allowing a network or mesh type of track layout where vehicles can select paths at each switch using an on board switch mechanism, this switch mechanism being able to transfer torsional moments from the vehicle cabin to the track at all times when negotiating switches.

DETAILED DESCRIPTION OF EMBODIMENTS

In the following embodiments of the invention will be described more in detail with reference to the enclosed drawings.

Figure 1:
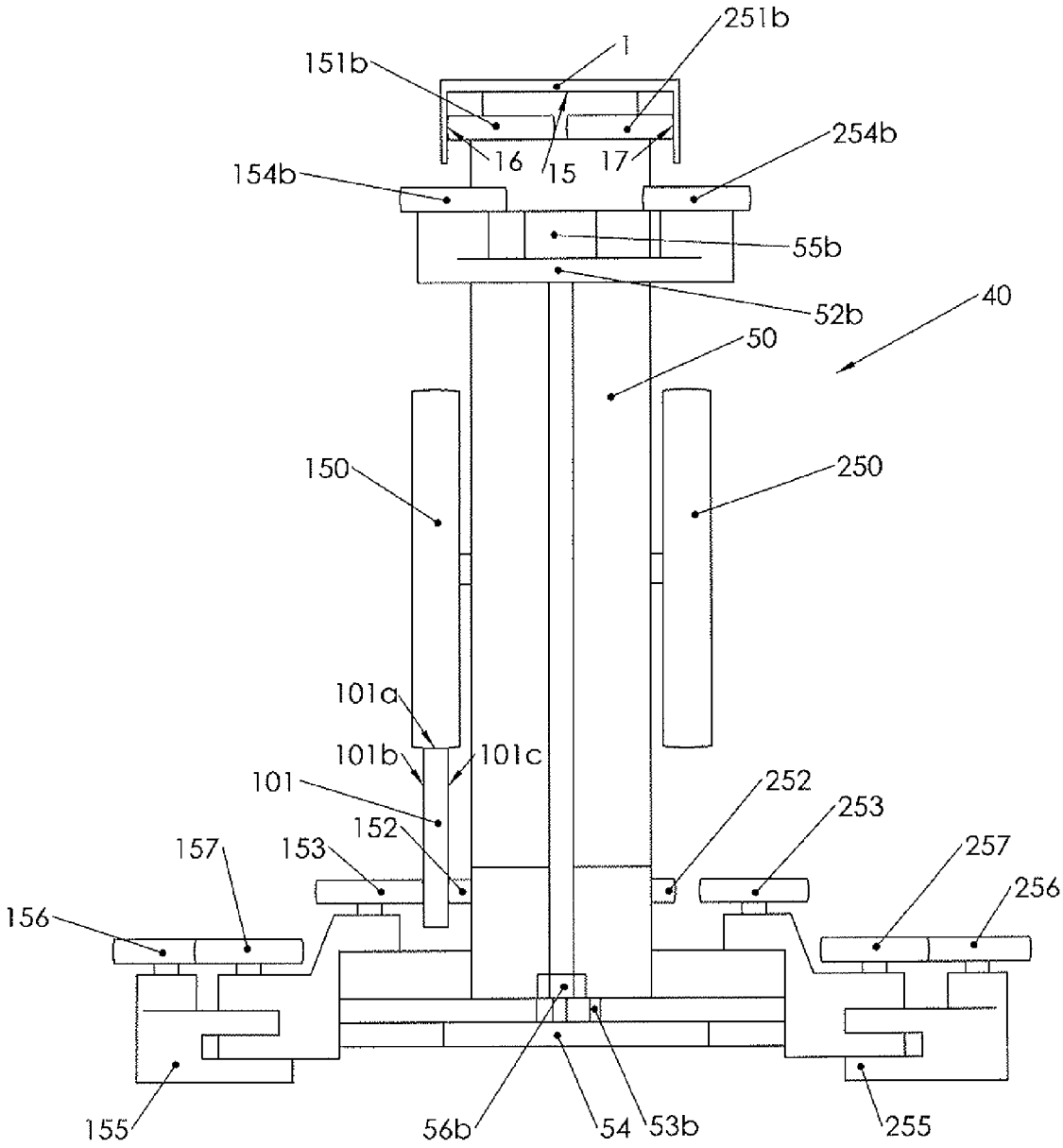
FIG. 1 is a sectional view of a bogie on a straight track section.

In FIG. 1 a preferred embodiment of a bogie is shown on a straight track section consisting of an upper u-shaped track member, the first track member 1, and a lower track member, referred to as the second track member 101, in this case arranged to the left in the direction of travel. These first 1 and second 101 track members are fixedly connected to each other, for instance using ribs (110, see FIG. 2) and preferably enclosed in a u-shaped cover with a downwards facing opening (not shown).

A bogie 40 has a bogie frame 50 holding left and right load bearing wheels 150, 250. In the shown embodiment, the left load bearing wheel 150 is in contact with the upwards facing surface 101*a* of the left second track member 101, thus transferring the downwards directed force from the bogie to the track. The bogie 40 is provided with upper guide wheels 151*a*, 151*b*, 251*a*, 251*b* carried by the bogie frame 50. The purpose of said upper guide wheels 151*a*, 151*b*, 251*a*, 251*b* is to keep the bogie aligned with the track at an upper level, i.e. at the level of the first track member 1. Attached to the bogie is, further, a set of left lower guide wheels 152, 153 including a left inner guide wheel 152 and a left outer guide wheel 153 with the purpose of keeping the bogie aligned with the track at a lower level, i.e. at the level of the second track member. Correspondingly, attached to the bogie is a set of right lower guide wheels 252, 253 including a right inner guide wheel 252 and a right outer guide wheel 253 with the purpose of performing the same task as the set of left lower guide wheel 152, 153 in a track section where a right second track member (not shown) is present. Alternatively, the track may be provided with a right second track member along the main part of the track and the bogie then being guided by said right lower guide wheels 252, 253 along the main part of the track and guided by said left lower guide wheels 152, 153 in a track section where a left second track member 101 is present.

The first track member 1 of the track provides an upper set of a first 16 wheel running surface and a second 17 wheel running surface facing each other in an inwards direction. Said wheel running surfaces 16, 17 are the inner surfaces of the flanges of a downwards facing U-shaped beam. The web of said U-shaped beam connecting said flanges has a downwards directed drive wheel running surface 15 for receiving the drive wheel of a bogie 40.

The second track member 101 of the track provides a lower set of wheel running surfaces including an upwards facing surface 101*a*, a first outwards directed surface 101*b* on a lateral side of said second track member 101 and a second inwards directed surface 101*c* on an opposite lateral side of said second track member 101, wherein said lower set of wheel running surfaces are offset in relation to a vertical plane intersecting a centre line between the upper set of wheel running surfaces. The term "centre line" is herein meaning a line which along the track is located between the wheel running surfaces 16, 17 of the first track member 1 at an equal distance to said wheel running surfaces 16, 17. This fact is herein referred to simply that the second track member 101 is laterally offset in relation to the first track member 1.

The first 1 and second 101 track members are rigidly connected to each other by means of ribs 110 (shown schematically in FIG. 2) at regular distances along the track. Said ribs keep the first and second track members at an equal distance along the track. Preferably, the first and second track members are made of steel and welded or bolted to the ribs.

A vehicle made for running along said track has a cabin suspended from at least two bogies 40, where said bogie on its part is suspended from the track having said first 1 and said second 101 track member.

A set of left lower guide wheels 152, 153 include said first lower guide wheel 153 located to run along a first lateral surface 101*b* of said second track member 101 and said second lower guide wheel 152 located to run along a second lateral surface 101*c* of said second track member 101.

A set of right lower guide wheels 252, 253 include said first lower guide wheel 253 located to run along a first lateral surface 201*b* of said second track member 201 and said second lower guide wheel 252 located to run along a second lateral surface 201*c* of said second track member 201.

A set of upper guide wheels includes: said first upper guide wheels 151*a*, 151*b* being located to run along a first inwards directed running surface, herein called a first guide surface 16 of said first track member 1 and second upper guide wheels 251*a*, 251*b* being located to run along a second inwards directed running surface, herein called a second guide surface 17 of said first track member 1, wherein as stated said first 16 and second 17 guide surfaces face each other.

Figure 2:
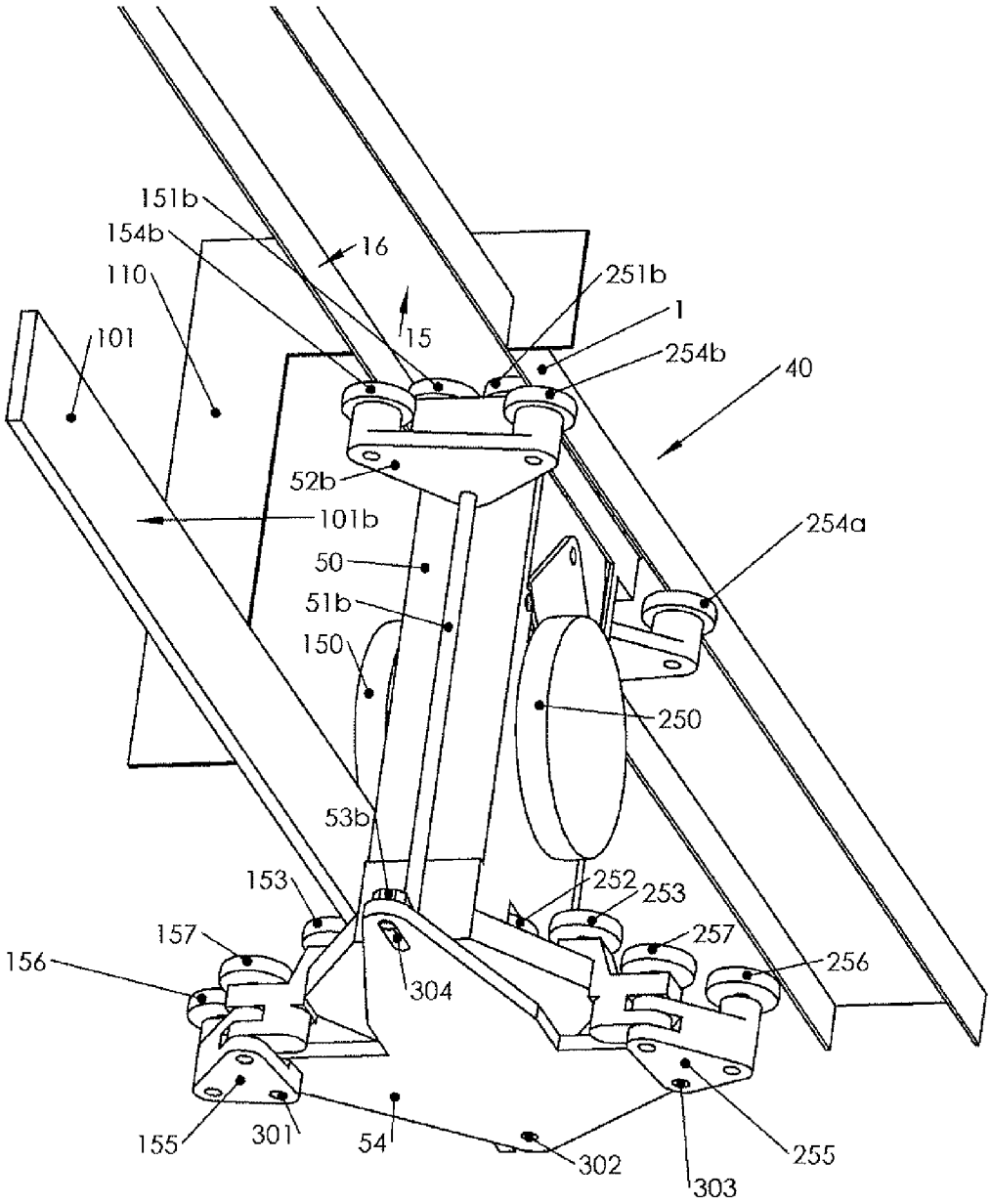
FIG. 2 is a perspective view of a bogie on a straight track section with the switch in a neutral position.

In a transportation system including a vehicle and the track for said vehicle, it is often a requirement to have the ability to switch the vehicle into different track routes at a switch section of the track. Hereinafter switching a vehicle bogie 40 in a switch section will be described. In FIG. 2 an aft switching shaft 51*b* (in the direction of bogie travel) can be seen. A corresponding fore switching shaft 51*a* can be seen in FIG. 7. The shaft 51*b* is pivotally connected to the bogie frame 50 by upper and lower bearings 55*b*, 56*b* (in FIG. 1) and holds an aft upper switch wheel holder 52*b* on which a left upper switch wheel 154*b* and a right upper switch wheel 254*b*, are mounted. Corresponding components in the fore can be seen in FIG. 7, wherein it is disclosed that the shaft 51*a* is pivotally connected to the bogie frame 50 by upper and lower bearings 55*a*, 56*a*, and wherein the fore shaft 51*a* holds a fore upper switch wheel holder 52*a* on which, in the fore end of the bogie, a left upper switch wheel 154*a* and a right upper switch wheel 254*a*, are mounted. The fore and aft switching shafts 51*a*, 51*b* can thus control engagement of the upper switch wheels by rotation of said shafts. The shafts 51*a*, 51*b* are forced to rotate by a switch drive (not shown), both shafts being connected to a switch plate 54 which performs an arc shaped mostly lateral movement, left or right, to perform switching. As a consequence of the arrangement, fore and aft shafts 51*a*, 51*b* will rotate in opposite directions upon movement of the switch plate 54. Lower switch wheel swingers 155, 255 are also engaged by the switch plate 54 so that they rotate synchronously with the lower switch cranks 53*a*, 53*b*, and also with the upper switch wheel holders 52*a*, 52*b* via the switch shafts 51*a*, 51*b*. Accordingly, upper switch wheels 154*a*, 254*a*, 154*b*, 254*b* are also rotated synchronously with the switching shafts 51*a*, 51*b*. Outer lower switch wheels 156, 256 are mounted on their respective lower switch wheel swingers 155, 255 while inner lower switch wheels 157, 257 are mounted directly on the bogie frame 50. The switch plate 54 can perform the arched movement as it is attached to three equal length crank functions at 301, 302, 303. The switch crank 53*b* is connected to the switch plate 54 by a pin in a slot arrangement 304 of the switch plate forcing the crank 53*b* and, via the switching shaft 51*b*, also the upper switch holder 52*b* to rotate in the opposite direction to the aforementioned three cranks functions 301, 302, 303 (See also FIG. 7).

The lower switch wheels include a left outer switch wheel 156 attached to a left swinger 155 and a right outer switch wheel 256 attached to a right swinger 255, wherein said left and right swingers are pivotally attached to said switch plate 54 by means of a crank functions 301, 303 and pivotally attached to the frame 50, whereby the left outer switch wheel 156 will rotate inwards towards the frame 50 when the right outer switch wheel 256 rotates outwards away from the frame 50, and vice versa, upon a movement of the switch plate 54.

Figure 3:
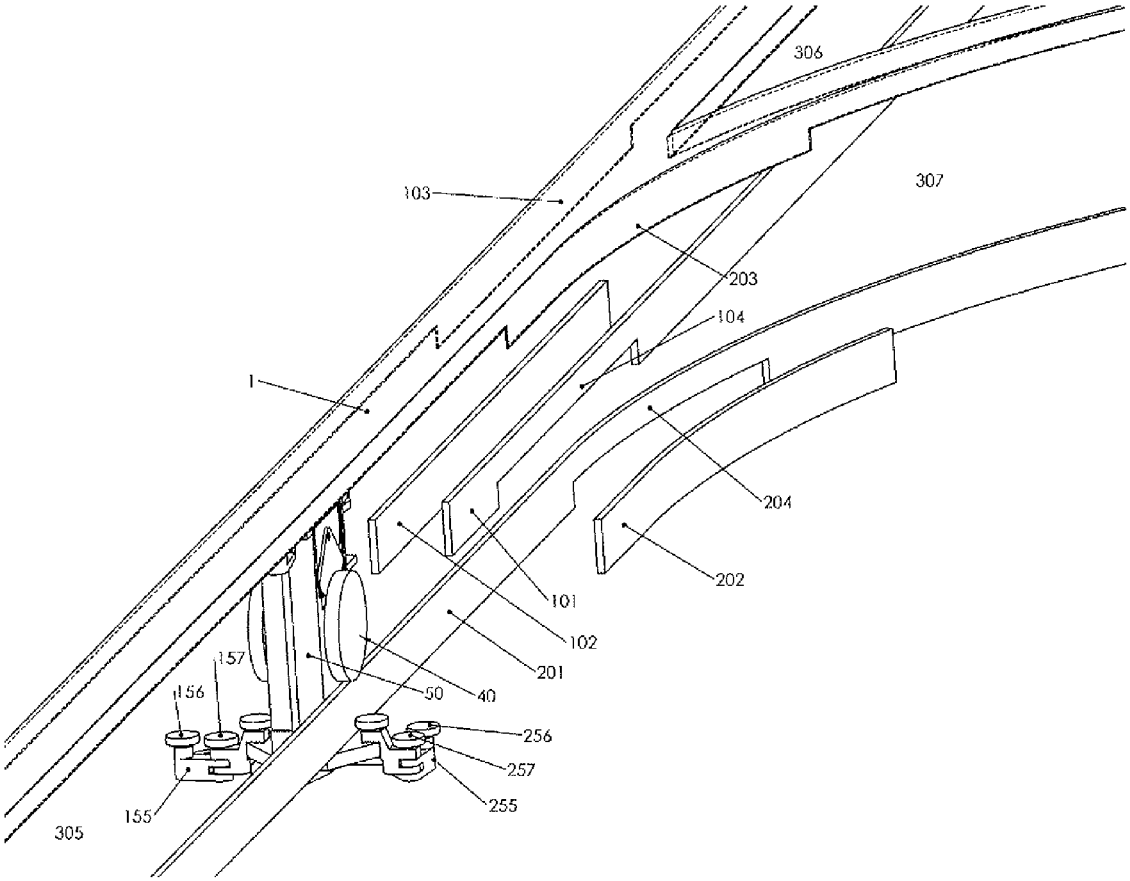
FIG. 3 is a perspective view of a switch showing a bogie set to run in a left direction out from the switch.

In FIG. 3 a bogie is approaching a switch from an entry point 305 and has its switch mechanism positioned to go to the left switch exit 306. When the bogie 40 reaches the starting point of lower switch rails 102, 202 the left lower outer switch wheel 156 will continue on the outer (left) side of the left lower switch rail 102 while the right lower outer switch wheel 256 will continue on the inside of the right lower switch rail 202, thus forcing the bogie to continue towards the left switch exit 306 at the lower vertical level. At the same time the upper left switch wheels 154*a*, 154*b* engage the left side of a downwards extended left flange 103 of the first track member 1 while the upper right switch wheels 254*a*, 254*b* continue on the inside of a downwards extended right flange 203, thus forcing the bogie to continue towards the left switch exit 306 at the higher vertical level. As the right lower switch rail 201 has a notch at position 204 lower right guide and switch wheels 253, 256, 257 are not blocked from following the straight path to the left switch exit 306. The fact that both upper and lower switch wheels work together to force the bogie towards the left switch exit 306 ascertains that any torsional moments that may be acting on the bogie 40 while it passes the switch can be transferred to the track, i.e. that the bogie is not allowed to rotate around a longitudinal axis even in the presence of such moments. Despite the denominations entry and exit used it is as feasible for a bogie to enter the switch from opposite directions at position 306 or position 307 and continue towards position 305 as well as going in the direction described here.

The lower switch rails 102, 202 are rigidly connected to the lower track members 101, 201 and the upper track member 1 by means of ribs similar to 110 at regular intervals within the switch section (not shown).

Figure 4:
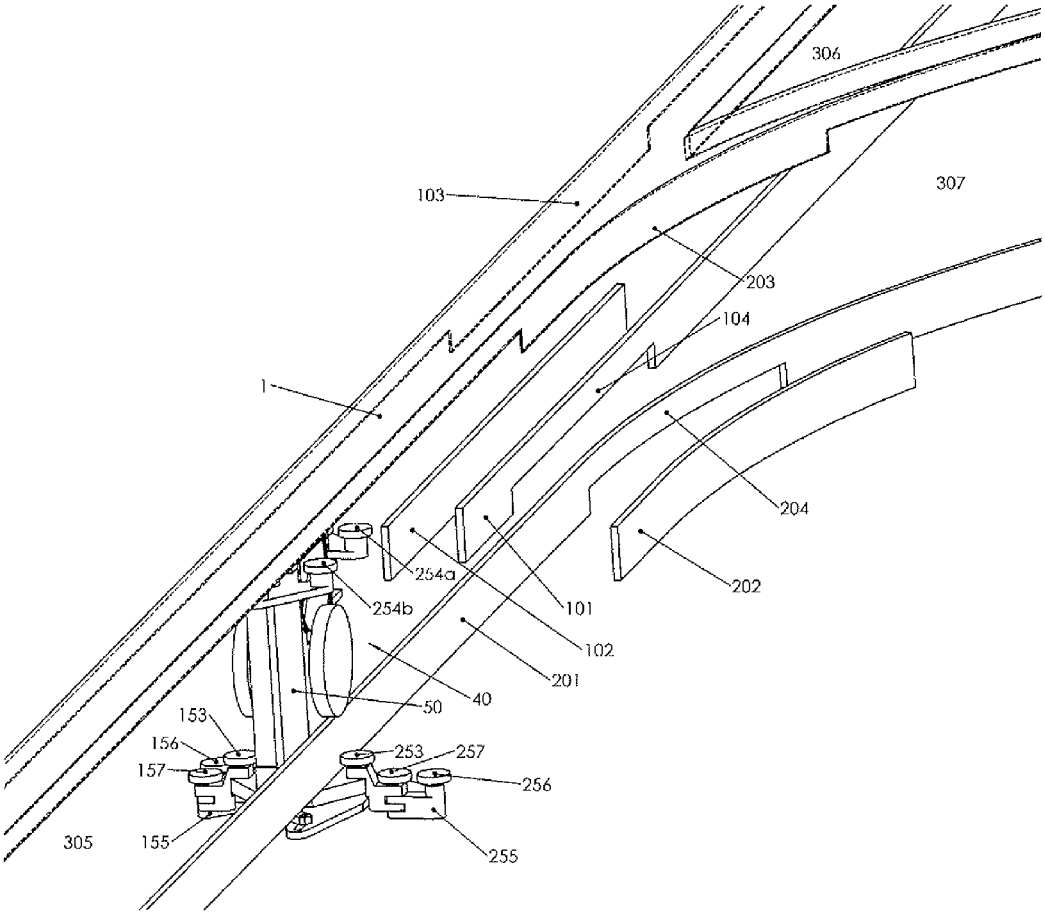
FIG. 4 is a perspective view of switch showing a bogie set to run in a right direction out from the switch.

FIG. 4 is very similar to FIG. 3 but in this figure the bogie 40 has its switch mechanism positioned to go to the right exit 307 of the switch. The right lower switch wheel swinger 255 has been rotated such that it has become positioned further away outwards from the centre of the bogie so that the right lower outer switch wheel 256 will pass on the outer (right) side of the right lower switch rail 202. As the right lower switch rail 202 is formed as a curve bending away, in a direction to the right, from the longitudinal direction of the track, the bogie is forced to follow the track towards the right exit 307 at the lower vertical level. At the same time the upper switch wheel holders 52*a*, 52*b* have been synchronously rotated, whereby the right upper switch wheels 254*a*, 254*b* have become correspondingly positioned further away outwards, to the right, from the centre of the bogie, so that said right upper switch wheels 254*a*, 254*b* will pass on the outside of a downwards extended right flange 203 of the first track member 1, thus forcing the bogie 40 to continue towards the right switch exit 307 at the higher vertical level. As the left lower rail 101 has a notch at position 104 of the drawing, lower left guide and switch wheels 153, 156, 157 are not blocked from following the curved path towards the right switch exit 307.

Figure 5:
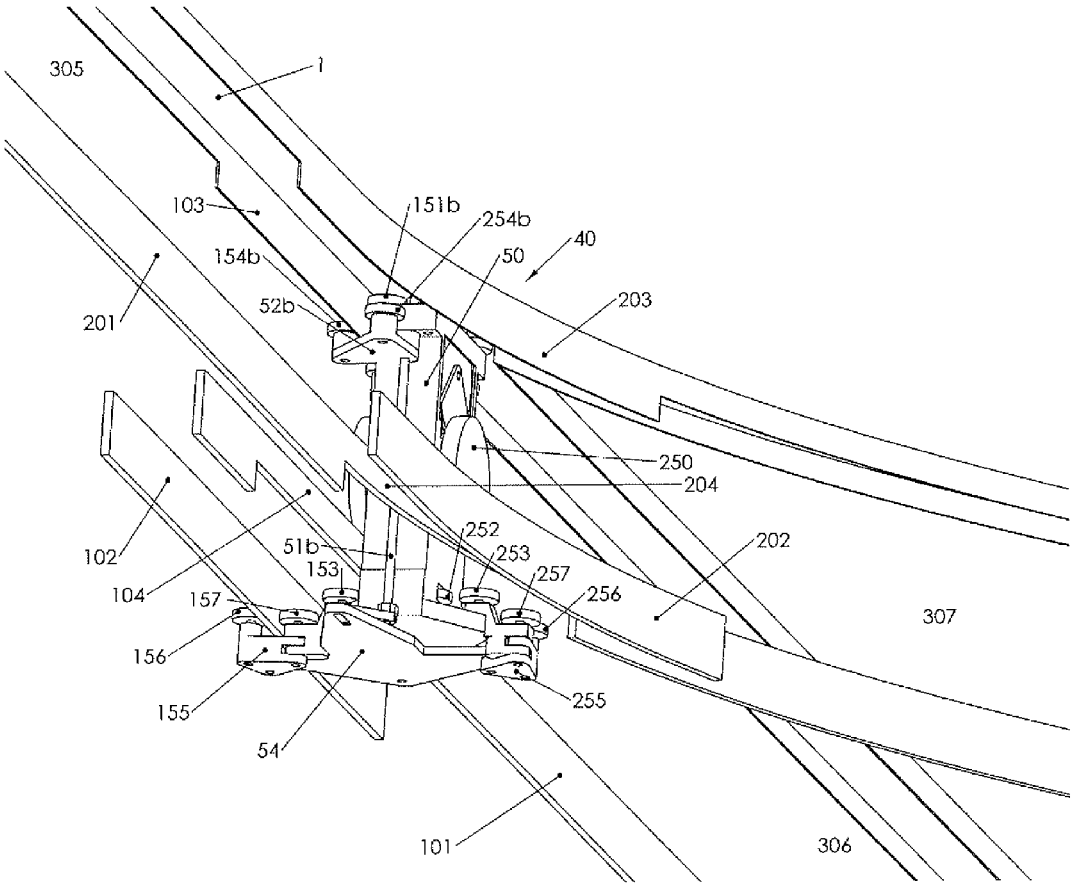
FIG. 5 is a perspective view from below of a bogie in the switch, bound left as shown in FIG. 3.

FIG. 5 shows a bogie 40 on its way towards the left switch exit 306. In this position the left upper switch wheels 154*a*, 154*b* are on the outside of the downwards extended left flange 103 of the upper track member 1 and together with the left upper guide wheels 151*a*, 151*b* they force the bogie to continue towards the left switch exit 306 at an upper level. The right upper switch wheels 254*a*, 254*b* are on the inside of the downwards extended right flange 203 of the upper track member 1 and can travel unhindered towards the left switch exit 306. The left lower outer switch wheel 156 is on the outside of the left lower switch rail 102 and together with the left lower inner switch wheel 157 it forces the bogie to continue towards the left switch exit 306 at a lower level. At this longitudinal position the lower guide wheels 153, 253 are disengaged from the lower track members 101, 201 thanks to the notches at positions 104 and 204 and can pass towards the left switch exit 306 without being engaged by said lower track members. The right lower outer switch wheel 256 has been rotated inwards, so that it can pass through the notch at position 204 towards the left switch exit 306 along with the right lower inner switch wheel 257.

Figure 6:
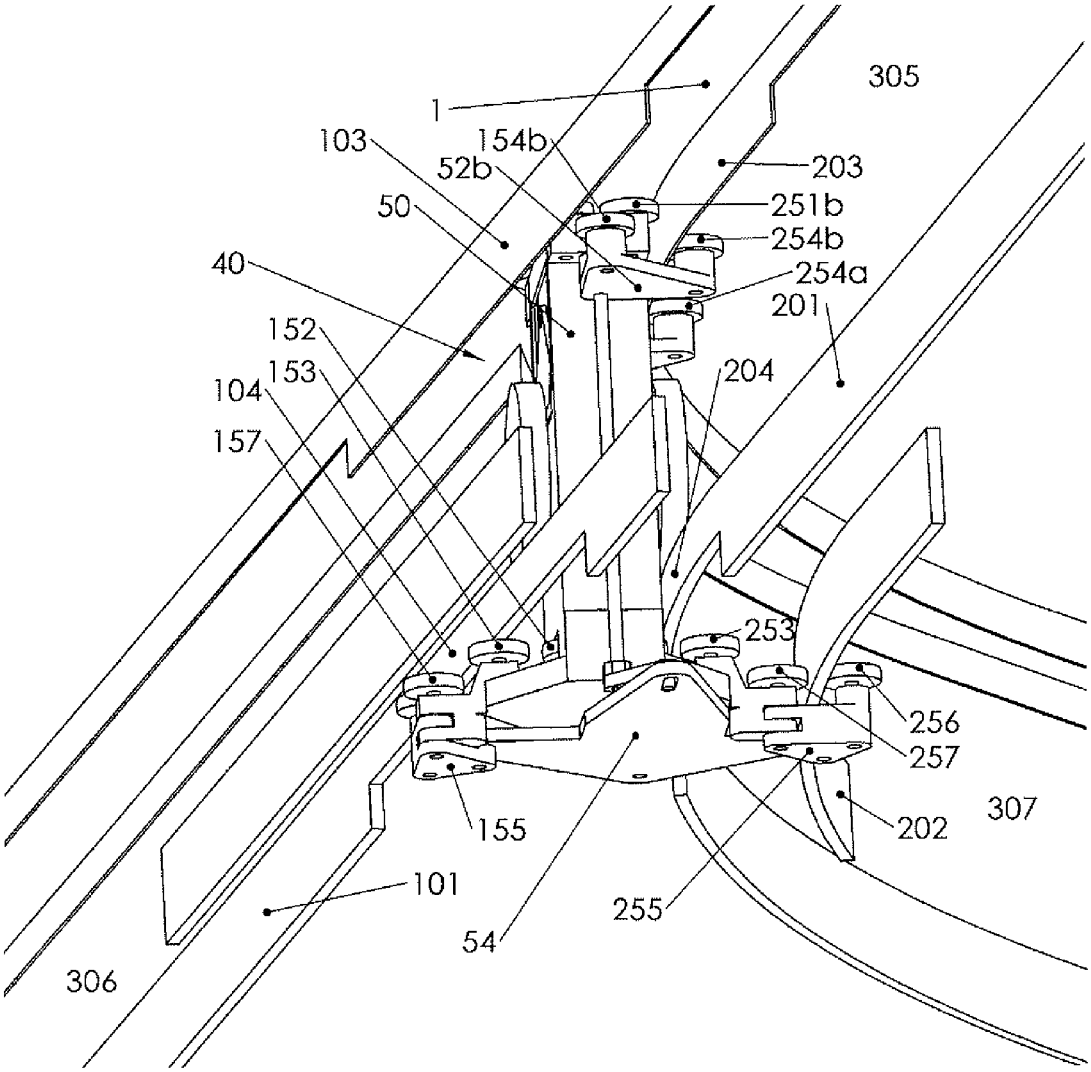
FIG. 6 is a perspective view from below of a bogie in the switch, bound right as shown in FIG. 4.

FIG. 6 shows a bogie 40 on its way towards the right switch exit 307. In this position the right upper switch wheels 254*a*, 254*b* have been rotated as described above in relation to FIG. 4, so that they are running on the outside of the downwards extended right flange 203 of the upper track member 1 and together with the right upper guide wheels 251*a*, 251*b* they force the bogie towards the right switch exit at 307 in the upper level. The left upper switch wheels 154*a*, 154*b* pass on the inside of the downwards extended left flange 103 of the upper track member 1 and can travel unhindered towards the right switch exit 307. The right lower outer switching wheel 256 is correspondingly positioned on the outside of the lower right switch rail 202 and together with the right lower inner switch wheel 257 it forces the bogie 40 to continue towards the right switch exit 307 at the lower level. The lower guide wheels 153, 253 are disengaged from the lower track members 101, 201 in this longitudinal position thanks to their notches at positions 104, 204 and can thus pass towards the right switch exit 307. The left lower switch wheel 156 has been rotated inwards to the right by means of left switch wheel swinger 155 so that it can pass through the notch at position 104 towards the right switch exit 307 along with the left lower inner switch wheel 157.

Figure 7:
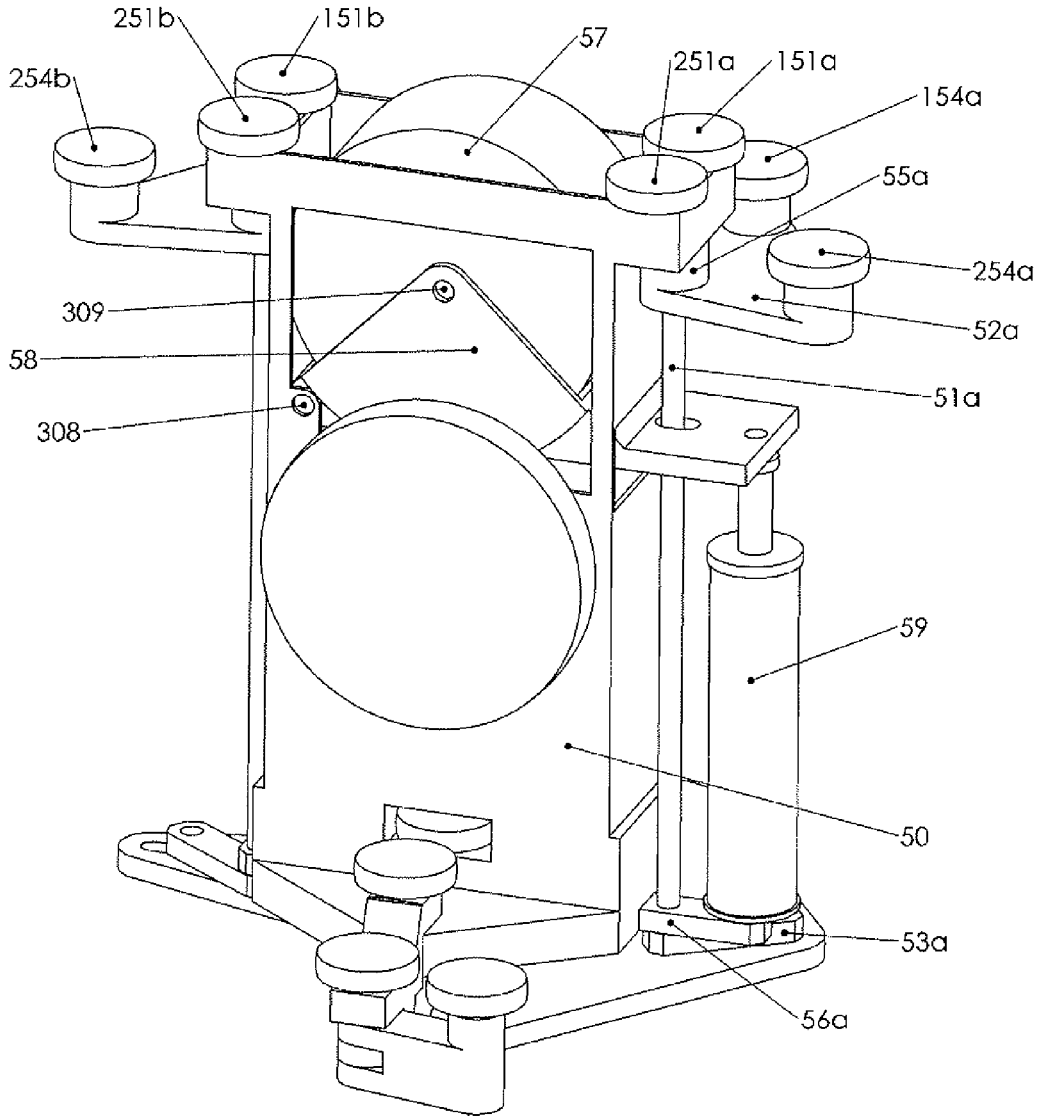
FIG. 7 is a side view of a bogie showing the upwards facing drive unit.

FIG. 7 shows one preferred drive mechanism utilizing a so called wheel motor symbolized by a drive wheel 57 which engages the downwards facing drive wheel running surface 15 (in FIG. 1.) of the first track member 1. The periphery of the wheel motor has a rubber coating or similar intended to increase friction. The normal force between the wheel motor and said drive wheel running surface 15 can be adjusted using a pressurizer actuator 59 here shown in the shape of a hydraulic cylinder, although the function could just as well be performed by an electric motor with some kind of gear box and a crank or excenter function. The force exerted by the pressurizer actuator is transferred to the wheel motor by means of a drive wheel pressurizer 58 shown here as a lever mechanism. The pressurizer 58 rotates around a first joint at 308 when the pressurizer actuator 59 moves it. This movement is transferred to the wheel motor by a second joint at 309, thus (mainly) changing the compression of the rubber coating of the wheel motor, which in turn affects the normal force of the drive wheel against the running surface 15 as intended.

The invention claimed is:

1. A track that supports suspended vehicles in a transportation system, comprising:

a first track member (1) having an upper set of first and second wheel running surfaces (16, 17) facing each other in an inwards direction;

a second track member (101) having a lower set of wheel running surfaces including: an upwards facing surface (101*a*), a first outwards directed surface (101*b*) on a lateral side of the second track member (101) and a second inwards directed surface (101*c*) on an opposite lateral side of the second track member (101); and said first track member and said second track member are spaced apart from each other and connected by means of ribs at regular distances along the track, wherein the first and second wheel running surfaces (16, 17) are inner surfaces of first and second flanges of a downwards facing U-shaped beam and wherein a web of the U-shaped beam connecting the first and second flanges has a downwards directed drive wheel running surface (15) for receiving a drive wheel (57) of a bogie (40) travelling along the track, wherein the track has a layout which allows vehicles to select paths solely through the use of an on board switch mechanism, the on board switch mechanism being able to transfer torsional moments from the vehicle to the track at all times when negotiating switches.

2. The track according to claim 1, wherein the lower set of wheel running surfaces are offset, laterally, in relation to a vertical center line between the upper set of wheel running surfaces (16, 17).

3. The track according to claim 1, wherein the track has a switch track section that is provided with left (102) and right (202) switch rails for guiding a bogie (40) travelling along the switch track section towards one of left and right exits (306, 307) and wherein along at least a portion of the switch track section the track is provided with left (101) and right (201) second track members.

4. The track according to claim 3, wherein the second track member (101, 201) has a notch (104, 204) along a portion of the switch track section.

5. The track according to claim 3, wherein the first track member (1) has a downward extended flange (103, 203) along a portion of the switch track section.

6. A bogie (40) that supports a vehicle suspended from a track having a first (1) and a second (101) track member connected by means of ribs at regular distances along the track, comprising:

at least one load bearing wheel (150, 250) arranged to run along an upwards facing surface (101*a*) of the second track member (101), a set of lower guide wheels including: a first lower guide wheel (153) arranged to run along a first lateral surface (101*b*) of the second track member (101) and a second lower guide wheel (152) arranged to run along a second lateral surface (101*c*) of the second track member (101), and at least one set of upper guide wheels including: a first upper guide wheel (151*a*, 151*b*) arranged to run along a first guide surface (16) of the first track member (1) and a second upper guide wheel (251*a*, 251*b*) arranged to run along a second guide surface (17) of the first track member (1), wherein the bogie (40) comprises a drive wheel arranged for running along a downwards facing running surface (15) of the first track member (1), wherein the bogie (40) comprises an on board switch mechanism capable of transferring torsional moments from the vehicle to an accommodating track layout at all times when negotiating switches and wherein vehicles can select paths solely through the use of the on board switch mechanism.

7. The bogie according to claim 6, wherein the bogie (40) is provided with a plurality of upper switching wheels (154*a*, 254*a*, 154*b*, 254*b*) arranged to engage a plurality of downwards extended flanges (103, 203) of the first track member (1) and a plurality of lower switch wheels (156, 157, 256, 257) arranged to engage a plurality of lower switch rails (102, 202) in switch sections of the track.

8. The bogie according to claim 7, wherein the bogie (40) comprises a switching shaft (51*a*, 51*b*) pivotally connected to a bogie frame (50), the switching shaft (51*a*, 51*b*) holding a switch wheel holder (52*a*, 52*b*), and the switch wheel holder (52*a*, 52*b*) holding the upper switching wheels (154*a*, 254*a*, 154*b*, 254*b*).

9. The bogie according to claim 8, wherein the switching shaft (51*a*, 51*b*) engages a switch plate (54) arranged to control the positions of the lower switch wheels (156, 256) in relation to a center line of the bogie.

10. The bogie according to claim 9, wherein the lower switch wheels include a left outer switch wheel (156) attached to a left swinger (155) and a right outer switch wheel (256) attached to a right swinger (255), the left and right swingers being pivotally attached to the frame (50) and pivotally attached to the switch plate (54) at positions (301, 303), wherein the left outer switch wheel (156) rotates inwards towards the frame when the right outer switch wheel (256) rotates outwards away from the frame (50), and the left outer switch wheel (156) rotates away from the frame when the right outer switch wheel (256) rotates inwards towards the frame (50), upon a movement of the switch plate (54).

11. The bogie according to claim 10, wherein a crank (53*a*) is fixedly attached to the switching shaft (51*a*) and pivotally connected to switch plate (54) at position (302) forcing the switching shaft (51*a*) to rotate with the left and right swingers (155, 255).

12. The bogie according to claim 10, wherein a crank (53*b*) is fixedly attached to the switching shaft (51*b*) and connected to switch plate (54) by means of a slot (304) arranged in the switch plate forcing the switching shaft (51*b*) to rotate in the opposite direction to the swingers (155, 255).

13. The bogie according to claim 7, wherein the bogie (40) comprises fore and aft switching shafts (51*a*, 51*b*) pivotally connected to a bogie frame (50), the switching shafts (51*a*, 51*b*) holding a plurality of switch wheel holders (52*a*, 52*b*), and the switch wheel holders (52*a*, 52*b*) holding the upper switching wheels (154*a*, 254*a*, 154*b*, 254*b*).

14. The bogie according to claim 13, wherein the switching shafts (51*a*, 51*b*) engage a switch plate (54) arranged to control the positions of the lower switch wheels (156, 256) in relation to a center line of the bogie.

15. The bogie according to claim 14, wherein the fore and aft switching shafts (51*a*, 51*b*) rotate in opposite directions during a switching action.

16. The bogie according to claim 15, wherein:

the lower switch wheels include a left outer switch wheel (156) attached to a left swinger (155) and a right outer switch wheel (256) attached to a right swinger (255), the left and right swingers being pivotally attached to the frame (50) and pivotally attached to the switch plate (54) at positions (301, 303), the left outer switch wheel (156) rotates inwards towards the frame when the right outer switch wheel (256) rotates outwards away from the frame (50), and the left outer switch wheel (156) rotates outwards away from the frame when the right outer switch wheel (256) rotates inwards towards the frame (50), upon a movement of the switch plate (54)

a fore crank (53*a*) is fixedly attached to the fore switching shaft (51*a*) and pivotally connected to the switch plate (54) at position (302) forcing the fore switching shaft (51*a*) to rotate with the swingers (155, 255); and, an aft crank (53*b*) is fixedly attached to the aft switching shaft (51*b*) and connected to the switch plate (54) by means of a slot (304) arranged in the switch plate forcing the aft switching shaft (51*b*) to rotate in the opposite direction to the swingers (155, 255).

17. The bogie according to claim 16, wherein the bogie (40) is provided with a drive wheel arranged for running along a downwards facing running surface (15) of the first track member (1).

18. A transportation system comprising:

a track comprising:

a first track member (1) having an upper set of first and second wheel running surfaces (16, 17) facing each other in an inwards direction;

a second track member (101) having a lower set of wheel running surfaces including: an upwards facing surface (101*a*), a first outwards directed surface (101*b*) on a lateral side of the second track member (101) and a second inwards directed surface (101*c*) on an opposite lateral side of the second track member (101), and said first track member and said second track member are spaced apart from each other and connected by means of ribs at regular distances along the track;

first and second bogies (40) each comprising:

at least one load bearing wheel (150, 250) arranged to run along an upwards facing surface (101*a*) of the second track member (101);

a set of lower guide wheels including: a first lower guide wheel (153) arranged to run along a first lateral surface (101*b*) of the second track member (101) and a second lower guide wheel (152) arranged to run along a second lateral surface (101*c*) of the second track member (101); and, at least one set of upper guide wheels including: a first upper guide wheel (151*a*, 151*b*) arranged to run along a first guide surface (16) of the first track member (1) and a second upper guide wheel (251*a*, 251*b*) arranged to run along a second guide surface (17) of the first track member (1);

wherein the first and second wheel running surfaces (16, 17) are inner surfaces of first and second flanges of a downwards facing U-shaped beam and wherein a web of the U-shaped beam connecting the first and second flanges has a downwards directed drive wheel running surface (15) for receiving a drive wheel (57) of a bogie (40) travelling along the track, wherein the bogies (40) and the track are designed such that vehicles can select paths solely through the use of an on board switch mechanism, the on board switch mechanism being able to transfer torsional moments from the vehicle to the track at all times when negotiating switches; and, a vehicle that runs along the track and having a cabin suspended from the first and second bogies.

* * * * *